United States Patent [19]

Ivanov

[11] 4,341,175

[45] Jul. 27, 1982

[54] SHIPBUILDING METHOD AND COMPLEX

[76] Inventor: Jury P. Ivanov, Grazhdansky prospekt, 92/2, kv. 1., Leningrad, U.S.S.R.

[21] Appl. No.: 259,528

[22] Filed: May 1, 1981

Related U.S. Application Data

[63] Continuation of Ser. No. 48,631, Jun. 14, 1979, abandoned.

[30] Foreign Application Priority Data

Jun. 16, 1978 [SU] U.S.S.R. ..... 2622027
Jun. 16, 1978 [SU] U.S.S.R. ..... 2622028

[51] Int. Cl.[3] ..... B63B 3/02

[52] U.S. Cl. ..... 114/65 R; 114/77 R; 114/74 R

[58] Field of Search ..... 114/65 R, 77 R, 74 R, 114/74 A; 405/1, 4, 3, 6

[56] References Cited

U.S. PATENT DOCUMENTS

| | | | |
|---|---|---|---|
| 3,680,512 | 8/1972 | Yamura | 114/77 R |
| 3,742,889 | 7/1973 | Weise | 114/65 R |
| 3,875,887 | 4/1975 | Futrup et al. | 114/65 R |
| 3,942,459 | 3/1976 | Sato | 114/77 R |
| 3,951,088 | 4/1976 | Hikai et al. | 114/65 R |
| 3,955,523 | 5/1976 | Kawaskami | 114/65 R |
| 4,018,180 | 4/1977 | Yoshida | 114/65 R |

FOREIGN PATENT DOCUMENTS

| | | | |
|---|---|---|---|
| 1330876 | 5/1963 | France | 114/77 R |
| 97144 | 10/1960 | Norway | 114/65 R |

*Primary Examiner*—Galen L. Barefoot
*Attorney, Agent, or Firm*—Robert E. Burns; Emmanuel J. Lobato; Bruce L. Adams

[57] ABSTRACT

A shipbuilding complex having a dry dock with a dock adjacent area, and a flooding chamber which is adjacent to the head of the dry dock and communicates therewith. An intermediate gate divides the dry dock into a main part which is adjacent to the water area, and a head part which is next to the flooding chamber. The flooding chamber and the head part of the dry dock make up a two-level docking basin. A method for building vessels in this shipbuilding complex is as follows. The aft end and components of the parallel middlebody are assembled in the dock apron area and successively transferred to the upper floor of the junction chamber, whereupon they are floated to and placed on the lower floor of the docking basin to be then transferred to the main part of the dry dock. The latter is used to join together the aft end and the parallel middlebody components, whereupon the preassembled fore end is joined to these to complete the hull. In case gas carriers are assembled in the complex, the tanks are mounted in the middlebody afloat.

9 Claims, 19 Drawing Figures

SHIPBUILDING METHOD AND COMPLEX

This is a continuation of application Ser. No. 048,631. filed June 14, 1979, now abandoned.

FIELD OF THE INVENTION

The present invention relates to shipbuilding and, more particularly, to shipbuilding complexes and methods for building ships at such complexes.

The shipbuilding complex in accordance with the invention is preferably intended for building tankers, bulk and ore carriers, gas carriers and combination bulk carriers of all types, including OO, OB, OBO and PROBO vessels.

BACKGROUND OF THE INVENTION

There is known a shipbuilding complex to build tankers, bulk and ore carriers and combination bulk carriers (cf. Navires, ports et chantlers, 1969, No. 226, pp. 197–200). Vessels constructed at such a shipbuilding complex are of the type that comprises an aft end, a parallel middlebody and a fore end.

The prior-art shipbuilding complex comprises a dry dock with a dock adjacent area, and a flooding chamber adjacent to the head of the dry dock. The flooding chamber must be long enough to make room for two assembly stations: the aft end is assembled at the head of the flooding chamber, whereas hull parts without the fore end are assembled in the area of the flooding chamber adjacent to the dry dock.

The shipbuilding complex under review operates as follows.

After a completed ship is floated from the dry dock, the water level therein is raised to a level high enough to flood the flooding chamber so as to set afloat the hull parts found there at the moment. The hull without the fore end is transferred to the dry dock; the aft end is moved to that part of the flooding chamber which is next to the dry dock. The flooding chamber and dry dock are then emptied so that the hull components are placed on their floors. The dry dock is used to complete the hull without the fore end and at the same time assemble the fore end; the flooding chamber is used to add the parallel middlebody to the aft end; the vacant assembly station at the head of the flooding chamber is used to assemble the aft end of another vessel.

The foregoing shipbuilding method is such that the overall dock length must be at least 900 to 1,000 meters; clearly, it takes such money and effort to build a structure of that size.

The absence of an intermediate gate in the dry dock makes it impossible to use the progressive flow-position assembly method. According to this method, individual hull components are successively brought to the dry dock to be joined together; this method makes it possible to substantially reduce the length (and, conequently, the cost) of the flooding chamber and curtail the slipway period of construction, because a considerable share of assembly operations is carried out in closed erection shops.

There are known a number of methods for building gas carriers which have a fore end, a parallel middlebody accommodating tanks for liquefied gas, and on aft end.

One of such methods is described in "Zosen", 1976, vol. XX, No. 11, and in "Kawaski Topics", August 1977, No. 67.

According to this method, the hull is built in a dock, whereas the tanks are built in a closed shop. Conventional cranes are used to install the tanks in the hull.

The tanks of modern gas carriers are very heavy and have to be lifted by cranes whose capacity, as a rule, is higher than that of a crane that would be used to build a vessel's hull along. High-capacity cranes are quite expensive.

There is further known a method for building liquefied gas carriers without using cranes in the course of the construction (of. French Pat. No. 2,158,851, Cl. B63b, 9/00, of 1973).

According to this method, the hull and tanks are assembled in an H-shaped dock. One chamber of the dock is used to assemble the hull; liquefied gas tanks are assembled in the second chamber which is parallel to the first. The sizes of the two chambers are about equal.

Through the transverse chamber, completed tanks are transferred to the chamber accommodating the hull which at this stage is composed of a fore end and aft end spaced at a distance which is greater than the length of the tanks. The tanks are installed afloat after the H-shaped dock is flooded, hull parts are set afloat.

The flooding of the dock accommodating a hull under construction accounts for a relatively long time on the stocks of construction. The method under review is also disadvantageous in that it requires a costly second dock chamber for the assembly of tanks.

According to this method, the tanks can be installed in the hull only by using high-capacity cranes or by flooding the dry dock and setting the gas carrier's hull afloat.

SUMMARY OF THE INVENTION

It is an object of the present invention to curtail the time on the docks of vessel construction and substantially reduce the costs of dock facilitities and equipment.

It is another object of the invention to dispense with the necessity of flooding the entire dry dock accommodating a hull under construction.

The foregoing and other objects of the invention are attained by providing a shipbuilding complex comprising a dry dock with a dock adjacent area, and a flooding chamber adjacent to the head of the dry dock and communicating with the said dry dock, the shipbuilding complex being characterized, in accordance with the invention, in that the dry dock is divided by an intermediate gate into a main part which is adjacent to the water area, and a head part adjacent to the flooding chamber and is combined therewith into a two-level docking basin whose upper level, or floor, is the flooding chamber and lower level, or floor, is the head part of the dry dock.

The foregoing design makes it unnecessry to flood the entire dry dock accommodating a hull under construction, which facilitates the hull construction and turns it into a continuous, rhythmic process.

The objects of the invention are further attained by providing a method for using the above shipbuilding complex to build vessels of the type that comprises a fore end, a parallel middle-body and an aft end, which method is characterized, in accordance with the invention, in that the dock adjacent area is used to assemble the aft end and components or the parallel middlebody, which are then successively transferred to the upper floor of the docking basin which is flooded to set them afloat, whereupon the aft end and parallel middlebody components are moved further and, as the docking basin is emptied, are set on the lower floor of said docking basin to be then transferred to the main part of the dry dock where the aft end, parallel middlebody components and fore end are joined together into a completed hull.

The method makes it possible to curtail the slipway period of construction, because many assembly operations are carried out in closed erection shops; the method also makes it possible to reduce the length and cost of the flooding chamber which is used to transfer hull components to the dry dock.

The shipbuilding method and complex according to the invention can be used to build liquefied gas carriers comprising a fore end, a parallel middlebody accommodating tanks for liquefied gas, and an aft end. It is expedient in this case that the dock adjacent area should be used to assemble the aft end, the part of the parallel middlebody which is intended to accommodate the tanks, and the tanks per se, whereupon the aft end is moved to the upper floor of the docking basin and is set afloat the docking basin is flooded; the aft end is then towed to the farther end of the docking basin which is emptied so that the aft end is lowered onto the lower floor and is then transferred to the main part of the dry dock. The part of the parallel middlebody, which is intended to accommodate the tank, and the tank per se are then successively transferred to the docking basin which is flooded again; the part of the parallel middlebody is set afloat and thus receives the tank, whereupon it is transferred to the main part of the dry dock where the aft end is joined to the parallel middlebody with the tank and to the preassembled fore end.

The foregoing method makes it possible to dispense with expensive high-capacity cranes and dramatically reduce the length and, consequently, the cost of the dry dock.

The method may be carried out in a different way. After the aft end is set on the bottom of the dry dock, the part of the parallel middlebody, which is intended to accommodate the tanks, is moved onto the upper floor of the docking basin which is filled with water so that the part of the parallel middlebody can be transferred to its far end, whereupon the docking basin is emptied to place the parallel middlebody component on the lower floor. The tank is then brought to the upper floor, the docking basin is flooded and the tank and that part of the parallel middlebody, which is intended to accommodate it, are set afloat. The tank is introduced into the parallel middlebody and is installed therein by emptying the docking basin; the whole is then transferred to the main chamber of the dry dock.

The above method is advantageous in that it makes possible to minimize the length and cost of the upper-level section of the junction chamber.

The method of this invention can further be carried out as follows. After the aft end has been placed on the bottom of the dry dock, the part of the parallel middlebody, which is intended to accommodate the tank, and the tank itself are brought to the upper floor of the docking basin which is flooded so that the tank is set afloat to be introduced into the floating part of the parallel middlebody; it is then installed in the parallel middlebody as the docking basin is partially emptied; the parallel middlebody with the tank is then towed to the farther end of the docking basin and, as the latter is emptied completely, is lowered on to the lower floor to be transferred to tha main part of the dry dock.

This minimizes the number of floodings of the docking basin required to install the tank in the parallel middlebody and place the parallel middlebody with the tank on the lower floor of the docking basin.

BRIEF DESCRIPTION OF THE ACCOMPANYING DRAWINGS

Other objects and advantages of the present invention will become more apparent from a consideration of the following detailed description of preferred embodiments thereof, taken in conjunction with the accompanying drawings, wherein.

DETAILED DESCRIPTION OF THE INVENTION

Referring to the attached drawings, the shipbuilding complex according to the invention comprises a dry dock 1 (FIG. 1) and a flooding chamber 2 which is adjacent to the head of the dry dock 1 and communicates therewith. In fact, the flooding chamber 2 is an extension of the dry dock 1. The flooding chamber 2 may be arranged at a perpendicular to the dry dock 1 (this arrangement is not shown). The arrangement of the chamber 2 depends on the dockyard layout. The bottom of the flooding chamber 2 is level with a dock adjacent area 3.

Figures 1, 2, 3, 4, 5, 6, 7:
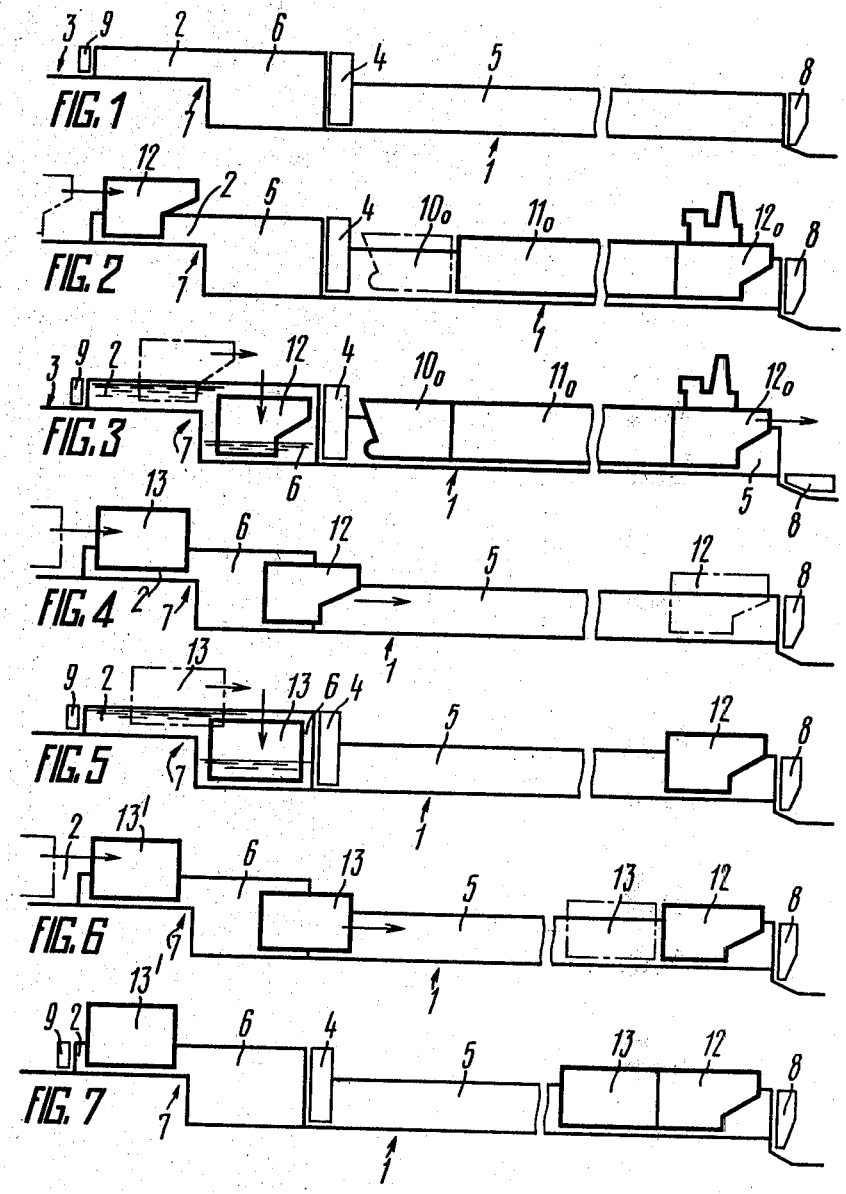
FIG. 1 is a longitudinal section of a shipbuilding complex in accordance with the invention.
FIG. 2 is a schematic illustration of the way the aft end is placed on the upper floor of the docking basin, in accordance with the invention.
FIG. 3 is a schematic illustration of the way the aft end is transferred from the upper to the lower floor of the junction chamber, in accordance with the invention.
FIG. 4 is a schematic illustration of the way a part of the parallel middlebody is placed on the upper floor of the docking basin and the aft end is transferred from the lower floor of the junction chamber to the main part of the dry dock, in accordance with the invention.
FIG. 5 is a schematic illustration of the way the part of the parallel middlebody is transferred from the upper to the lower floor of the docking basin, in accordance with the invention.
FIG. 6 is a schematic illustration of the way the part of the parallel middlebody is transferred from the lower floor of the docking basin to the main part of the dry dock, in accordance with the invention.
FIG. 7 is a schematic view of the aft end and part of the parallel middlebody attached thereto, in accordance with the invention.

The dry dock is divided by an intermediate gate 4 into a main part 5 which is adjacent to the water area, and a head part 6 which is next to the flooding chamber 2. The part 6 and flooding chamber 2 combine into a two-level docking basin 7 (FIG. 1). The upper floor of the docking basin 7 is the flooding chamber 2, while its lower flood is the head part 6 of the dry dock 1, separated by the intermediate gate 4 from the main part 5.

For reasons of simplicity, the upper floor of the docking basin 7 will now be designated by reference numeral 2 and the lower floor by reference numeral 6.

A main gate 8 separates the dry dock 1 from the water area. A gate 9 separates the flooding chamber 2 from the dock adjacent area 3.

The shipbuilding complex according to the invention can be used to build various types of vessels having a fore end 10, a parallel middlebody 11 and an aft end 12. Such vessels include tankers, bulk and ore carriers and combination bulk carriers of all types, such as OO, OB, OBO and PROBO vessels.

The shipbuilding complex according to the invention operates as follows.

The dock apron area 3 is used to assemble the aft end 12 and parts 13 of the parallel middlebody 11, which is done by any conventional technique.

The components of one and the same vessel have a certain identification mark placed to the right of and below the reference number, for example, $10_o$, $11_o$ (FIG. 2); parts of the parallel middlebody of one and the same vessel are designated at 13, the identification sigh being to the right of and above 13, for example, $13^1$ (FIGS. 6 and 7).

The aft end 12 and parts 13 are successively brought to the upper floor 2 of the docking basin 7. The aft end 12 is the first to be brought to the upper floor 2 (FIG. 2); as this takes place, the gate 9 is open. When the aft end 12 is set on the upper floor 2, the gate 9 is closed and the docking basin 7 is flooded to set the aft end 12 afloat and move it (FIG. 3) to the part 6 of the docking basin 7. The latter is then emptied, and the aft end 12 is placed on the lower floor 6. As the upper floor 2 emerges from the water (FIG. 4), the part 13 of the parallel middlebody 11 is set thereon. The timing of this operation is determined by the construction schedule.

After the docking basin 7 is emptied completely, the gate 4 is opened and the aft end 12 is transferred to the main part 5 of the dry dock 1, which operation is preceded by bringing the previously completed hull out of the dock 1 to the water area.

As the part 13 of the parallel middlebody 11 is placed on the upper floor 2 of the docking basin 7 and the gates 9 and 4 are closed, the docking basin 7 is flooded and the part 13 (FIG. 5) of the parallel middlebody 11 is set afloat and towed to the part 6 of the docking basin 7. The latter is emptied to lower the part 13 onto the lower floor 6. As the upper floor 2 emerges from the water (FIG. 6), the next part $13^1$ of the parallel middlebody 11 is placed thereon. The timing of this operation is determined by the construction schedule.

When the docking basin 7 is empty, the gate 4 is opened and the part 13 of the parallel middlebody 11 is transferred (FIG. 7) to the main part 5 of the dry dock 1 to be joined to the aft end 12.

The part $13^1$ and other parts of the parallel middlebody 11 are transferred to the main part 5 of the dry dock and described above (FIGS. 5, 6 and 7) and are successively joined to the rest of the hull. When all the parts 13 of the parallel middlebody 11 have been moved to the main part 5 of the dry dock 1, the fore end 10 is assembled. The fore end 10 is assembled on the dock adjacent area 3 to be then transferred to the main part 5 of the dry dock and attached to the rest of the hull. The fore end 10 is brought to the dry dock 1 like the aft end 12 (FIGS. 2 and 3).

The fore end 10 may be assembled in the main part 5 of the dry dock 1. The order in which the hull components 12, 13 and 10 are joined to one another may be different and is determined by specific assembly techniques.

The foregoing sequence of operations is repeated for the next vessels.

The shipbuilding complex according to the invention can also be used to build gas carriers of the LNG and LPG types. Such vessels also comprise the fore end 10, the parallel middle-body 11 and the aft end 12; they also have tanks 14 for liquefied gas.

Gas carriers are assembled as follows.

The dock adjacent area 3 is used to assemble the aft end 12 and the parts 13 of the parallel middlebody 11, which are intended to accommodate the tanks 14. The tanks 14 are also assembled in the dock adjacent area 3.

The part 13 of the parallel middlebody 11 and the tank 14, which is to be installed in the part 13, have the same identification marks, such as $13^1$ and $14^1$ (FIGS. 12, 13, 17, 18 and 19).

The completed aft end 12 is brought to the upper floor 2 of the docking basin 7 as described above (FIGS. 2, 3 and 4). It is then transferred to the main part 5 of the dry dock 1.

The parts 13 of the parallel middlebody 11 and tanks 14 are then successively brought to the docking basin 7 (FIGS. 8 through 19). The docking basin 7 is flooded to set the tanks 14 and parts 13 afloat and install the former in the latter, whereupon the parts 13 with the tanks 14 are transferred to the main part 5 of the dry dock to be attached to the rest of the hull.

The fore end 10 is assembled at this point as described above and joined to the rest of the hull.

The sequence in which the aft end 12, the parts 13 of the parallel middlebody 11, accommodating the tanks 14, and the fore end 10 are joined together may be different and is determined by specific hull assembly techniques.

The above sequence of operations is repeated for the next vessels.

In some cases the placing of the aft end 12 on the lower floor 6 of the docking basin 7 or on the bottom of the main part 5 of the dry dock 1 is followed by bringing the part 13 of the parallel middlebody 11 to the upper floor 2 (FIG. 8) of the docking basin 7.

As this takes place, the gate 9 is open. As it is closed, the docking basin 7 is filled to a level high enough for the part 13 of the parallel middlebody 11 to be set afloat. In the meantime the gate 4 is closed. The floating part 13 of the parallel middlebody 11 is moved to the section 6 of the docking basin 7 (FIG. 9) and is placed on the floor 6 by emptying the junction chamber 7.

Figures 8, 9, 10, 11, 12, 13:
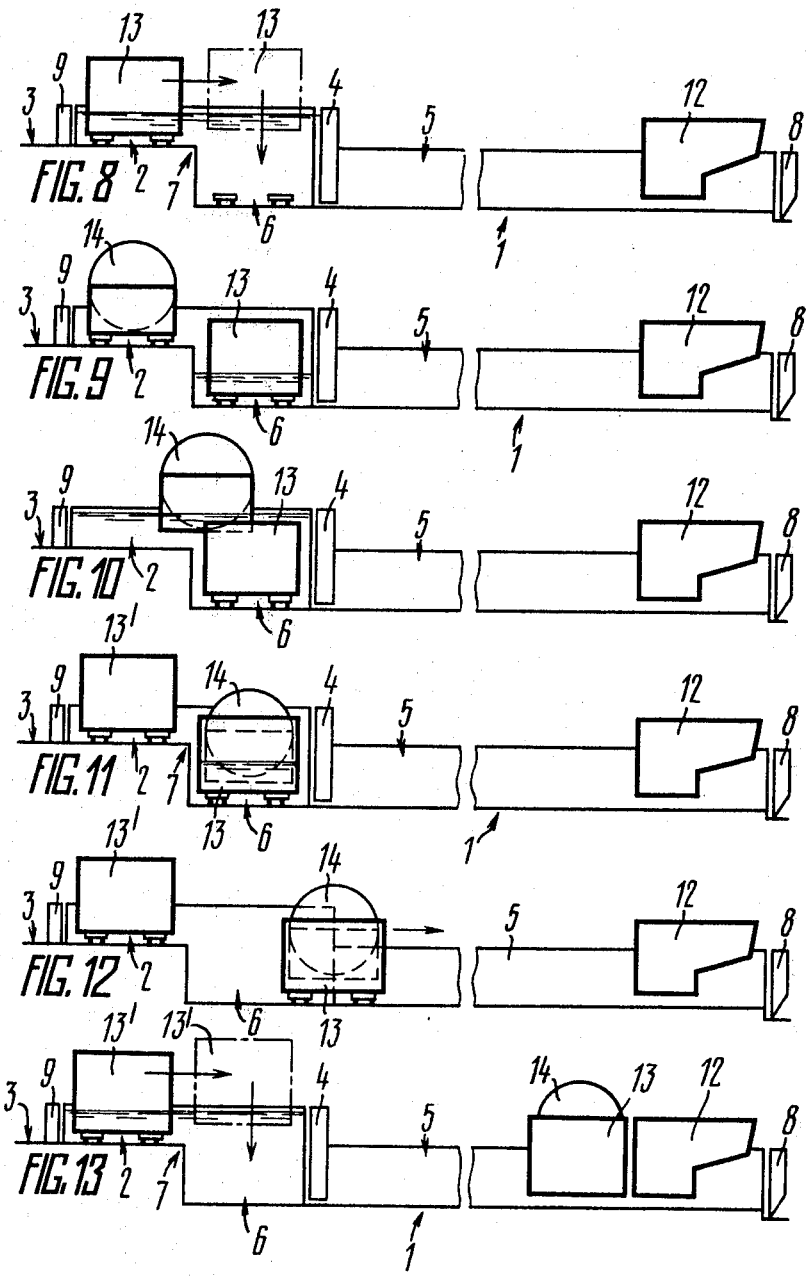
FIG. 8 is a schematic illustration of the way the part of the parallel middlebody, intended to accommodate the tank, is placed on the upper floor of the docking basin and transferred therefrom to the lower floor of the docking basin, in accordance with the invention.
FIG. 9 is a schematic illustration of the way the part of the parallel middlebody is placed on the lower floor of the docking basin, while the tank for liquefied gas is set on the upper floor of the docking basin, in accordance with the invention.
FIG. 10 is a schematic illustration of the way the tank is transferred from the upper to the lower floor of the docking basin and introduced into the part of the parallel middlebody, in accordance with the invention.
FIG. 11 is a schematic illustration of the way the tank is installed in the part of the parallel middlebody, in accordance with the invention.
FIG. 12 is a schematic illustration of the way the part of the parallel middlebody with the tank is transferred to the main part of the dry dock, in accordance with the invention.
FIG. 13 is a schematic illustration of the way the aft end is joined with the part of the parallel middlebody accommodating the tank, in accordance with the invention.
Figures 14, 15, 16, 17, 18, 19:
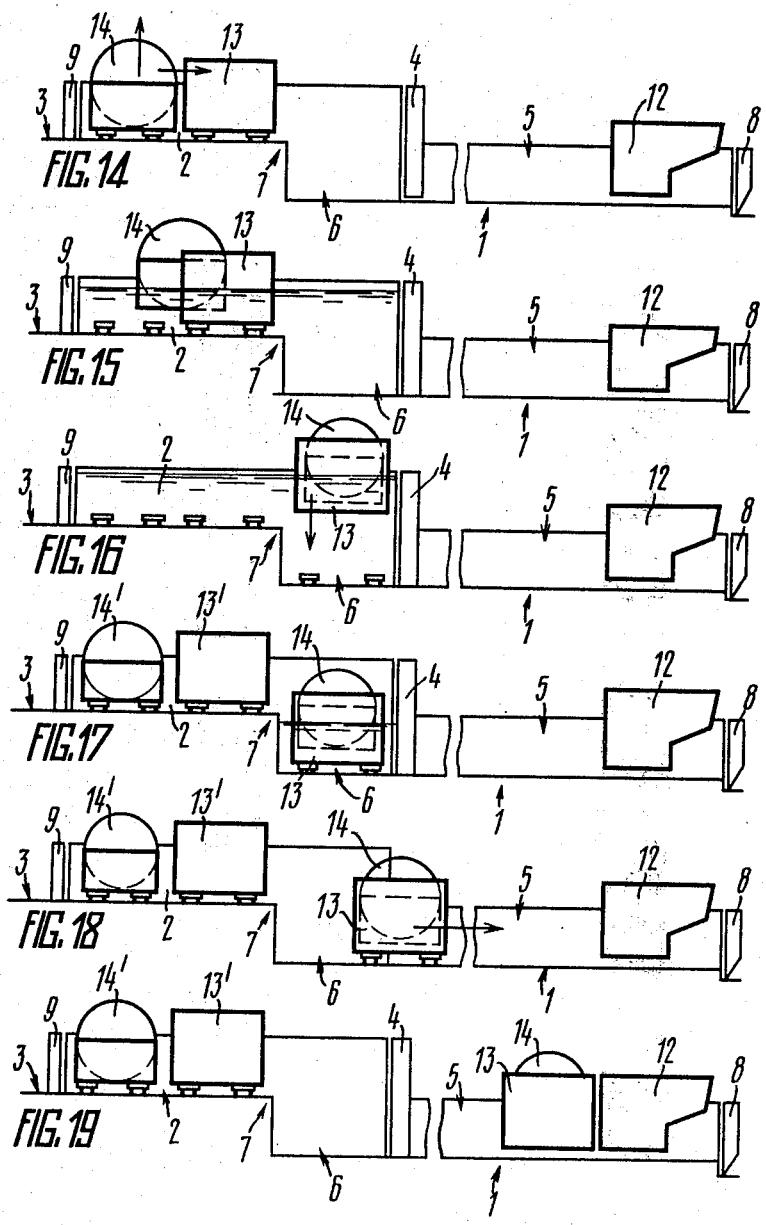
FIG. 14 is a schematic illustration of the way the part of the parallel middlebody and tank are set on the upper floor of the docking basin, in accordance with the invention.
FIG. 15 is a schematic illustration of the way the tank is installed in the part of the parallel middlebody, in accordance with the invention.
FIG. 16 is a schematic illustration of the way the part of the parallel middlebody with the tank installed therein is transferred from the upper to the lower floor of the docking basin, in accordance with the invention.
FIG. 17 is a schematic illustration of the way the part of the parallel middlebody accommodating the tank is set on the lower floor of the docking basin, in accordance with the invention.
FIG. 18 is a schematic illustration of the way the part of the parallel middlebody accommodating the tank is transferred from the lower floor of the docking basin to the main part of the dry dock, in accordance with the invention.
FIG. 19 is a schematic illustration of the way the aft end is joined to that part of the parallel middlebody which accommodates the tank, in accordance with the invention.

The gate 9 is opened and the tank 14 is brought to the vacant upper floor 2 (FIG. 9). The gate 9 is reclosed and the docking basin 7 is again flooded to a level high enough for the tank 14 (FIG. 10) to be set afloat. In the meantime the part 13 of the parallel middlebody 11 is ballasted and rests on the lower floor 6 of the docking basin 7. The floating tank 14 is towed to the section 6 of the docking basin 7, inserted into the part 13 of the parallel middlebody 11 and installed therein as the docking basin 7 (FIG. 11) is emptied.

After the upper floor 2 of the docking basin 7 has risen above the water, the next part 13[1] of the parallel middlebody 11 is brought thereto. The timing of this operation is determined by the construction schedule and techniques.

When the docking basin 7 is empty, the gate 4 (FIG. 12) is opened and the part 13 of the parallel middlebody 11, accommodating the tank 14, is transferred (FIG. 14) to the main part 5 of the dry dock 1 and joined to the aft end 12.

The part 13[1], tank 14[1] and other parts of the parallel middlebody 11 and other tanks are brought to the main part 5 of the dry dock 1 as described above (FIGS. 8 through 13) to be attached to the assembled portion of the hull. After all the parts 13 of the parallel middlebody 11 with their respective tanks 14 have been brought to the main part 5 of the dry dock 1, the fore end 10 is assembled and the hull is completed as described above.

There may be special cases. For example, when the aft end 12 has been placed on the bottom of the dry dock 1, the part 13 of the parallel middlebody 11 and the tank 14 are brought to the upper floor 2 (FIG. 14) of the docking basin 7. As this takes place, the gate 9 is open. After it is reclosed, the docking basin 7 (FIG. 15) is flooded to a level high enough for the tank 14 to be set afloat. In the meantime the part 13 of the parallel middlebody 11 is ballasted and rests on the upper floor 2 of the docking basin 7. The floating tank 14 is inserted into the part 13 to be installed therein by lowering the level of water in the docking basin 7. The water level in the docking basin 7 is risen again, the ballast of the part 13 of the parallel middlebody 11 is blown out, and the part 13, accommodating the tank 14, is brought to the far end of the docking basin 7 and is set on the lower floor 6 by emptying the junction chamber 7 (FIG. 7).

As the upper floor 2 of the docking basin 7 rises above the level of water, the gate 9 (FIG. 18) is opened and the next part 13[1] of the parallel middlebody 11 and the next tank 14[1] are placed on the upper floor 2 of the docking basin 7. The timing of this operation is determined by the construction schedule.

When the docking basin 7 is empty, the gate 4 is opened and the part 13 of the parallel middlebody 11, accommodating the tank 14, is transferred (FIG. 19) to the main part 5 of the dry dock 1 to be joined to the aft end 12.

The part 13[1] of the parallel middlebody 11 and the tank 14[1] and other parts of the parallel middlebody 11 and other tanks are transferred from the upper floor 2 of the docking basin 7 to the main part 5 of the dry dock 1 as described above (FIGS. 14 through 19) and are successively attached to the finished portion of the hull.

After all the parts 13 of the parallel middlebody 11 with their respective tanks 14 have been brought to the main part 5 of the dry dock 1, the fore end 10 is assembled as described above, and the hull is completed.

The shipbuilding method and complex according to the invention make it possible to use the highly effective progressive assembly method of ship construction, which is applicable to various types of vessels, including gas carriers. The method of this invention makes it possible to raise the utilization factor of dry docks and curtail the slipway construction period. The method of this invention also makes it possible to use a relatively cheap docking basin instead of expensive high-capacity cranes.

What is claimed is:

1. A method of making and assemblying hulls of vessels comprising, the steps of, assemblying a section of a hull of a vessel and floating it in a first area of a basin at a certain level, moving the preassembled section of a hull into a second area while in a floating condition, removing the water from said basin and settling said preassembled section of a hull onto a bottom floor level of said second area lower than a level of a bottom of said first area, after removal of the water from said basin placing said second area in communication with a contiguous drydock and moving said preassembled section of said hull into the contiguous drydock while free of water and maintained isolated from said basin until said section of a hull is settled at a level of said bottom floor area of said second area, again isolating said drydock from said basin second area, and repeating the steps until enough preassembled sections of a hull of a complete vessel are in said drydock while free of water for joining and assembly into a hull of a vessel.

2. A method of making and assemblying hulls of vessels according to claim 1, comprising, before removal of a given hull preassembled section into said drydock and when said given hull preassembled section has settled partially in said second area of the basin, partially flooding the first area and the second area, floating a structure in said first area upon again partially flooding of said first area and second area, moving the floating structure in registry with said given hull preassembled section, again removing the water from said basin and settling said structure onto said given preassembled section of a hull in the second area for subsequent movement into said drydock while on said given preassembled section of said hull for assembly therewith while in said drydock.

3. A shipbuilding complex for assembly of vessels comprising;

a drydock having a length and width for receiving in a given sequence, a plurality of individual, floatable, pre-assembled structures of a vessel at least some of which comprise pre-assembled sections of a hull of a vessel for assembly thereof into a hull of a vessel while the drydock is free of water; a floodable chamber in communication with the drydock; a first gate between the drydock and the chamber operable to a closed position isolating the drydock from the chamber maintaining the drydock free of water when the chamber is flooded, said chamber having an upper stage with an upper bottom level for receiving the pre-assembled floatable structures individually and floating them therein as the chamber is flooded and having a lower stage having a lower bottom level at the level of the bottom of the drydock, the lower stage being in direct communication with the upper stage for receiving floating, individual pre-assembled structures for lowering thereof to said lower bottom level as water is evacuated from said chamber; a second gate for opening and closing the chamber and operable to an open position for receiving of individual, floatable, pre-assembled structures in said upper stage and operable to a closed position for allowing flooding of the chamber with an individual, floatable, pre-assembled structure therein; and the first gate being operable to an open position when the water is evacuated from the flooded chamber for allowing moving of the individual structures from the lower bottom level into the drydock for joining and assembly thereof into a vessel including the hull thereof.

4. A shipbuilding complex for assembly of vessels according to claim 3, in which the difference in height between the upper bottom level and the lower bottom level is sufficient for a floatable, pre-assembled structure in a floating condition to be moved into the lower stage over and in registry with another pre-assembled structure resting on the lower bottom level and settled on to another pre-assembled structure as the water is evacuated from the chamber prior to movement of the two structures jointly into the drydock.

5. A shipbuilding complex for assembly of vessels comprising;

a drydock having a length and width for receiving in a given sequence, a plurality of individual, floatable, pre-assembled sections of a vessel each comprising a pre-assembled section of a hull of a vessel for assembly thereof into a hull of a vessel while the drydock is free of water; a floodable chamber in communication with the drydock; a first gate between the drydock and the chamber operable to a closed position isolating the drydock from the chamber maintaining the drydock free of water when the chamber is flooded, said chamber having an upper stage with an upper bottom level for receiving the pre-assembled sections individually and floating them therein as the chamber is flooded and having a lower stage having a lower bottom level at the level of the bottom of the drydock, the lower stage being in direct communication with the upper stage for receiving floating individual pre-assembled sections for lowering thereof to said lower bottom level as water is evacuated from said chamber; a second gate for opening and closing the chamber and operable to an open position for receiving of individual pre-assembled sections in said upper stage and operable to a closed position for allowing flooding of the chamber with an individual pre-assembled section therein; and the first gate being operable to an open position when the water is evacuated from the flooded chamber for allowing moving of the individual sections into the drydock while free of water for joining and assembly thereof into a vessel hull.

6. A shipbuilding complex for assembly of vessels according to claim 5, in which said upper bottom level is at a level of a surrounding area in which the pre-assembled sections are made.

7. A method of making and assemblying a vessel comprising, the steps of pre-assemblying an individual floatable section of a vessel, moving the floatable section into a floodable basin at a level about the level at which the floatable section was made, flooding the basin and floating the floatable section, moving the floating floatable section to a contiguous part of the basin for lowering thereof in a floating condition to a level of the basin lower than the first-mentioned level and at a lower level for removal to an adjacent drydock isolated from the basin, evacuating the water from the basin to lower the floating floatable section to the lower level bottom to bring it to rest at said lower level bottom, placing the basin in communication with the drydock, moving the floatable section on the lower level bottom into the drydock while free of water, after removal of the floatable section into the drydock isolating the drydock from the floodable basin, and repeating the steps until enough pre-assembled floatable sections are in said drydock while free of water for joining and assembly into at least a hull of a vessel.

8. A method of making and assemblying a vessel according to claim 7, including prior to moving the floatable section on the lower level bottom into the drydock, placing a floatable section of a vessel at said upper level and reflooding the chamber, moving the last-mentioned section into said lower level and evacuating the water from the chamber to lower the level of the water so that the last-mentioned section comes to rest on the section resting on the lower level bottom.

9. A method of making and assemblying a vessel according to claim 8, in which the last-mentioned section comprises a tank.

* * * * *